US009828772B2

(12) United States Patent
Murphey et al.

(10) Patent No.: US 9,828,772 B2
(45) Date of Patent: Nov. 28, 2017

(54) TRUSS DESIGNS, MATERIALS, AND FABRICATION

(71) Applicant: L'Garde, Inc., Tustin, CA (US)

(72) Inventors: Thomas W. Murphey, Fort Collins, CO (US); Juan M. Mejia-Ariza, Aliso Viejo, CA (US)

(73) Assignee: L'Garde, Inc., Tustin, CA (US)

( * ) Notice: Subject to any disclaimer, the term of this patent is extended or adjusted under 35 U.S.C. 154(b) by 0 days.

(21) Appl. No.: 15/181,206

(22) Filed: Jun. 13, 2016

(65) Prior Publication Data

US 2016/0362892 A1 Dec. 15, 2016

Related U.S. Application Data

(60) Provisional application No. 62/174,471, filed on Jun. 11, 2015.

(51) Int. Cl.

| | |
|---|---|
| ***E04H 12/00*** | (2006.01) |
| ***E04C 3/28*** | (2006.01) |
| ***E04C 3/00*** | (2006.01) |
| *E04H 12/18* | (2006.01) |
| *E04C 3/04* | (2006.01) |

(52) U.S. Cl.

CPC ..... *E04C 3/28* (2013.01); *E04C 3/005* (2013.01); *E04C 2003/0486* (2013.01); *E04H 12/18* (2013.01)

(58) Field of Classification Search

CPC ... E04C 2/38; E04C 2002/3488; E04H 12/00; E04H 2/18; E04H 12/34; B64G 1/22

USPC ..... 52/108

See application file for complete search history.

(56) References Cited

U.S. PATENT DOCUMENTS

| | | | | | |
|---|---|---|---|---|---|
| 4,475,323 | A * | 10/1984 | Schwartzberg | H01Q 15/161 | 343/881 |
| 4,557,083 | A * | 12/1985 | Zanardo | B64G 9/00 | 244/159.5 |
| 4,587,777 | A * | 5/1986 | Vasques | B64G 9/00 | 244/172.6 |
| 4,745,725 | A * | 5/1988 | Onoda | B64G 9/00 | 52/646 |
| 5,085,018 | A * | 2/1992 | Kitamura | H01Q 1/1235 | 52/108 |
| 5,163,262 | A * | 11/1992 | Adams | B64G 9/00 | 52/111 |
| 5,184,444 | A * | 2/1993 | Warden | B64G 9/00 | 52/108 |
| 6,904,722 | B2 * | 6/2005 | Brown | B64G 1/222 | 52/108 |
| 7,941,978 | B1 * | 5/2011 | Pollard | E04H 12/185 | 343/881 |
| 2002/0112417 | A1 * | 8/2002 | Brown | B64G 1/222 | 52/108 |
| 2004/0194397 | A1 * | 10/2004 | Brown | B64G 1/222 | 52/108 |
| 2005/0126106 | A1 * | 6/2005 | Murphy | B64G 1/222 | 52/652.1 |
| 2007/0145195 | A1 * | 6/2007 | Thomson | B64G 1/222 | 244/172.6 |

* cited by examiner

*Primary Examiner* — Beth Stephan
(74) *Attorney, Agent, or Firm* — Buchalter

(57) ABSTRACT

A truss is disclosed in which rigid longitudinal members define a frame and flexible connecting members permit the truss to collapse into a stowed configuration or expand into a deployed configuration.

17 Claims, 15 Drawing Sheets

TRUSS DESIGNS, MATERIALS, AND FABRICATION

PRIORITY

This application claims priority to U.S. Application No. 62/174,471, filed Jun. 11, 2015, which is incorporated by reference in its entirety into this application.

BACKGROUND

Trusses are used in many disciplines to support structures and other objects. A light weight, deployable truss is key to many space applications. However, many difficulties arise in creating a deployable truss. Some conventional systems permit the truss strut members to flex or bend to permit its collapse. However, such structures are limited in their structural strength as the supporting members are not rigid. Some conventional systems use rigid members to support the structure. However, these require attachment or actuation of members and joints that add weight to the system.

NASA has concluded that Solar Electric Propulsion (SEP) is the most efficient solution to perform deep space human exploration missions. In fact, studies have shown that SEP is a "big enabler" reducing launch mass by 50 percent (factor of two) and mass growth sensitivity by 60 percent. However, for large scale SEP vehicles, one of the biggest challenges is the construction, integration, and testing of large autonomously deployable solar arrays. This is why NASA is requesting innovative technologies that will guarantee the development of large deployable solar arrays over the next 20 years with up to 4,000 $m^2$ of deployed area (1 MW) for exploration missions using SEP.

One of the main challenges of the NASA Near-Earth Object (NEO) mission is to achieve at the same time a high structural efficiency and a low stowage volume that will guarantee a successful launch without the need of Extravehicular activity (EVA) for the 300 kW Government Reference Array (GRA) development. As a point of reference, the International Space Station (ISS) needed 4 launches and EVAs to generate ~250 kW.

SUMMARY

Exemplary embodiments provide a deployable truss comprising rigid components to support the truss and flexible components to permit the deployment or collapse of the truss. The flexible components are designed to maintain sufficient structural rigidity to support the truss, but also maintain sufficient flexibility to permit members to move relative to one another and collapse the structure.

DRAWINGS

Figure 1:
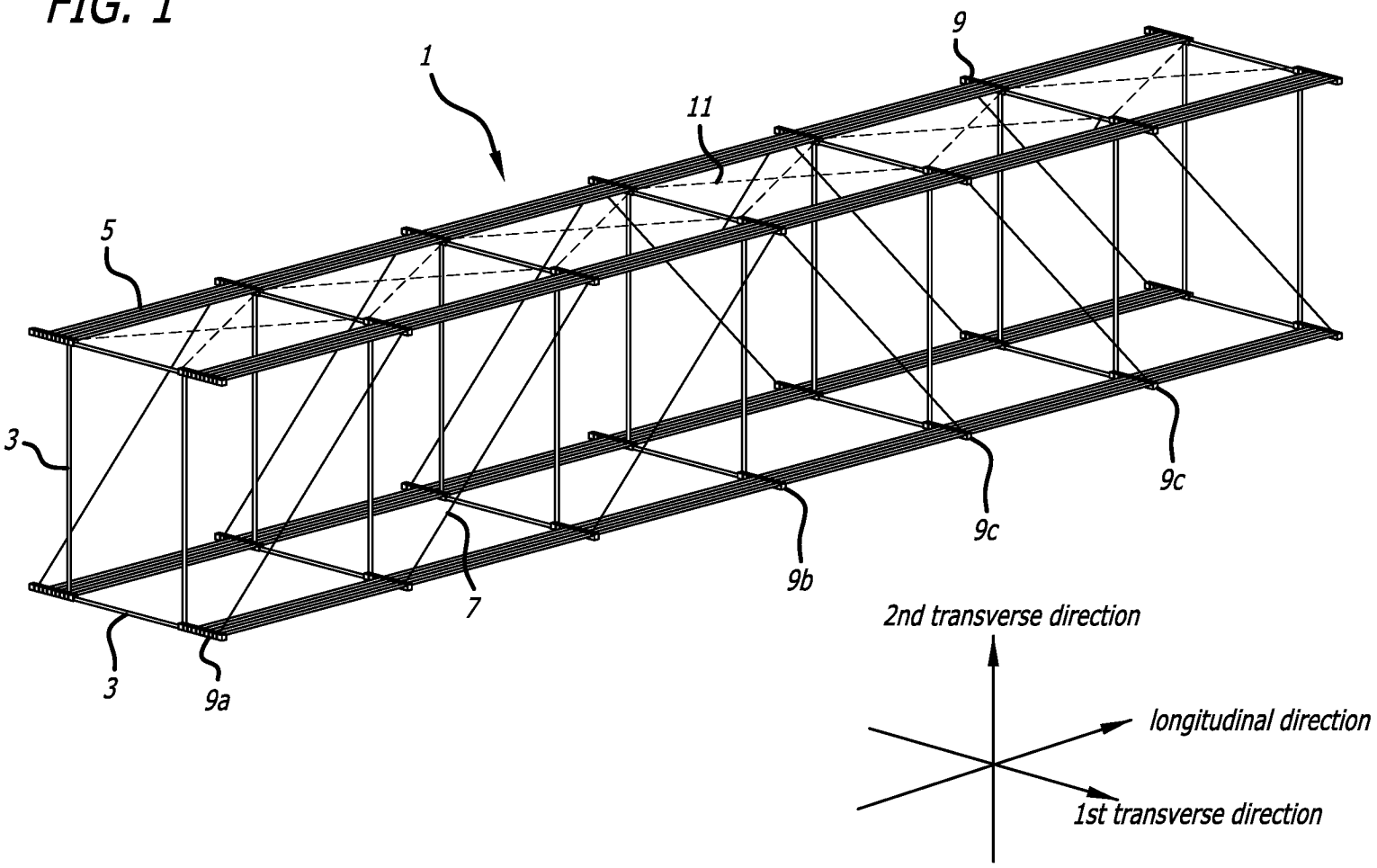
FIG. 1 illustrates an exemplary truss according to embodiments of the invention in a deployed configuration.
Figure 6A:
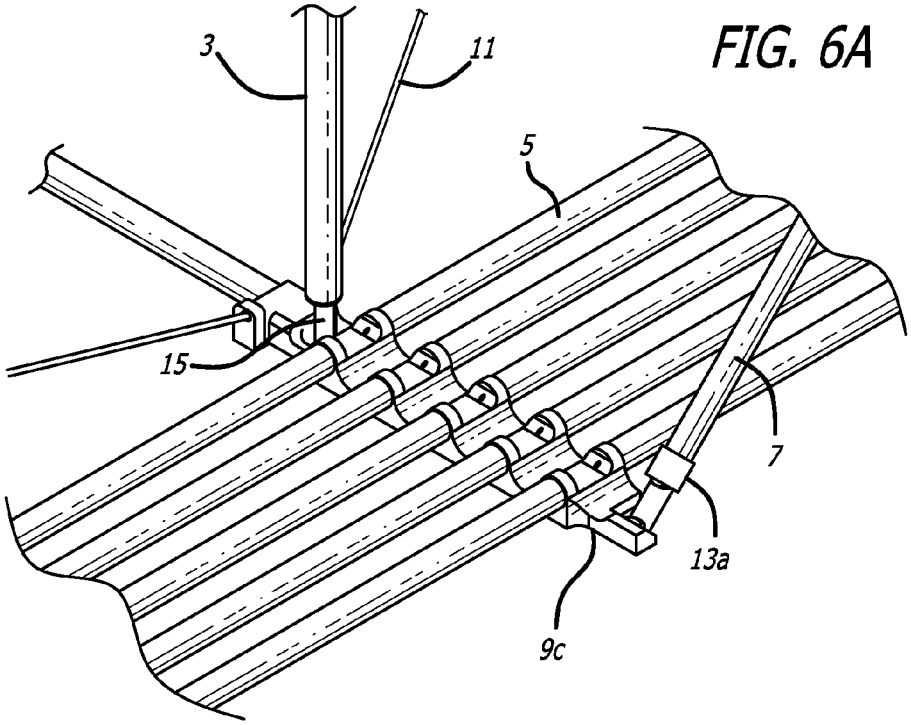
Figure 6B:
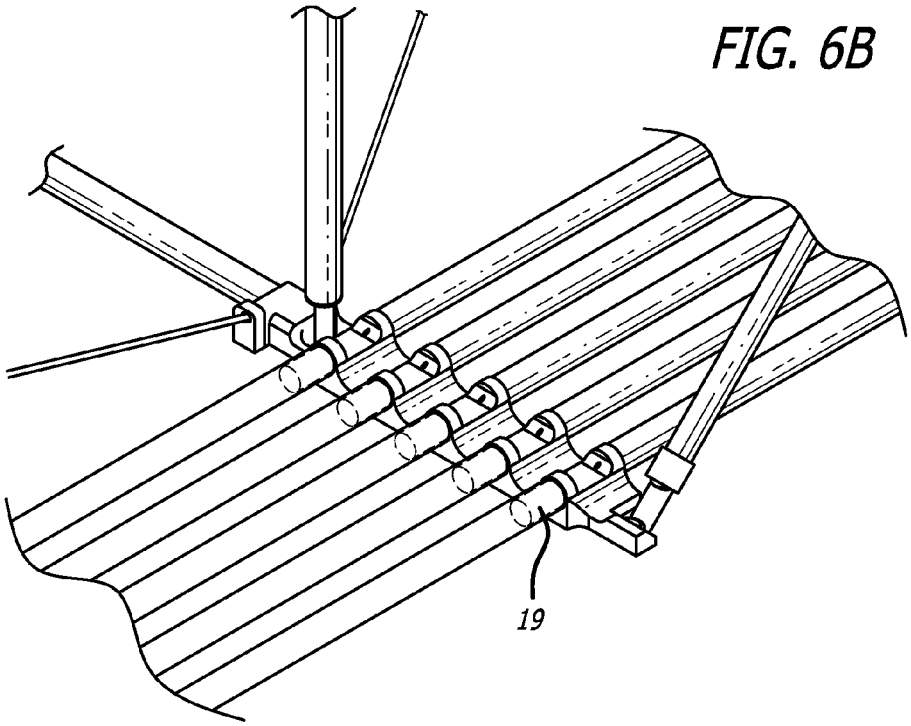
Figure 6C:
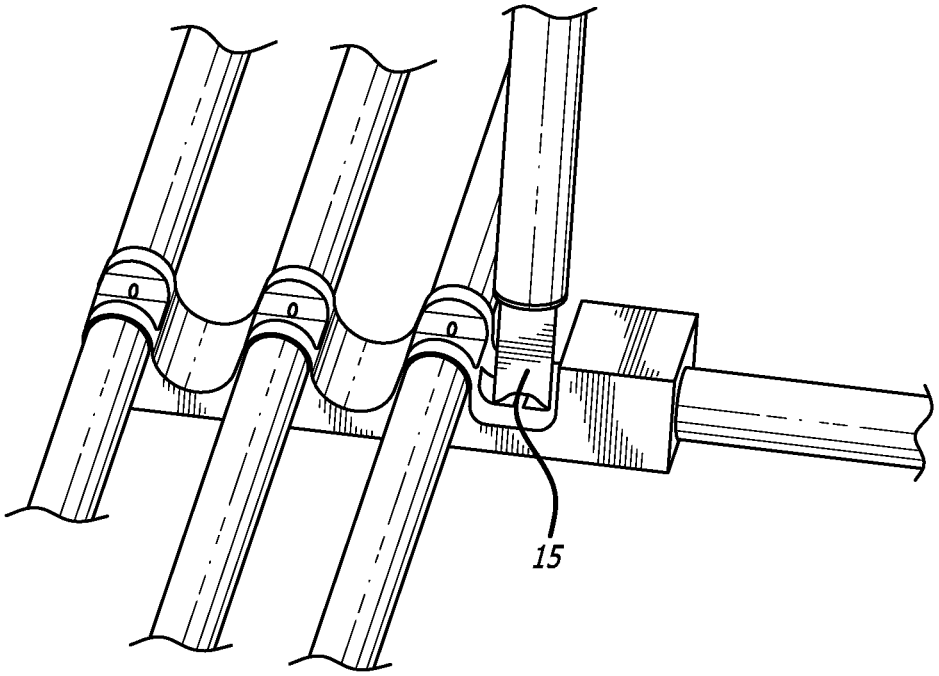

FIG. 6A illustrates a close up of a region of the truss of FIG. 1 including an exemplary interior rigid node according to embodiments of the invention in a deployed configuration. FIG. 6B illustrates the exemplary rigid node of FIG. 6A, with a set of longerons transparent to illustrate the internal connection between longeron and node. FIG. 6C illustrates a different perspective close up of the region of FIG. 6A.

Figure 7:
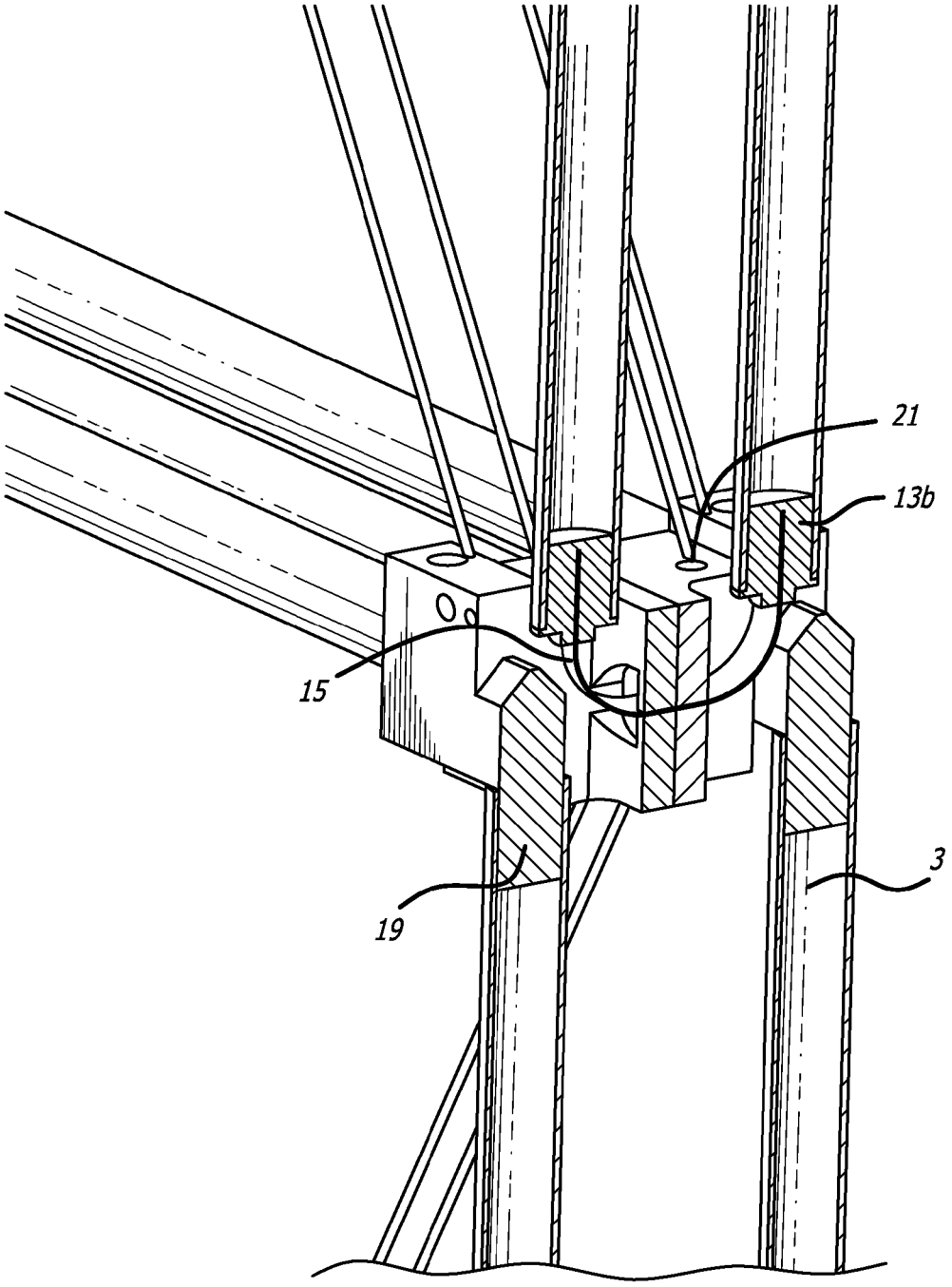

FIG. 7 illustrates a cut away cross section across a node in the stowed configuration.

Figure 2:
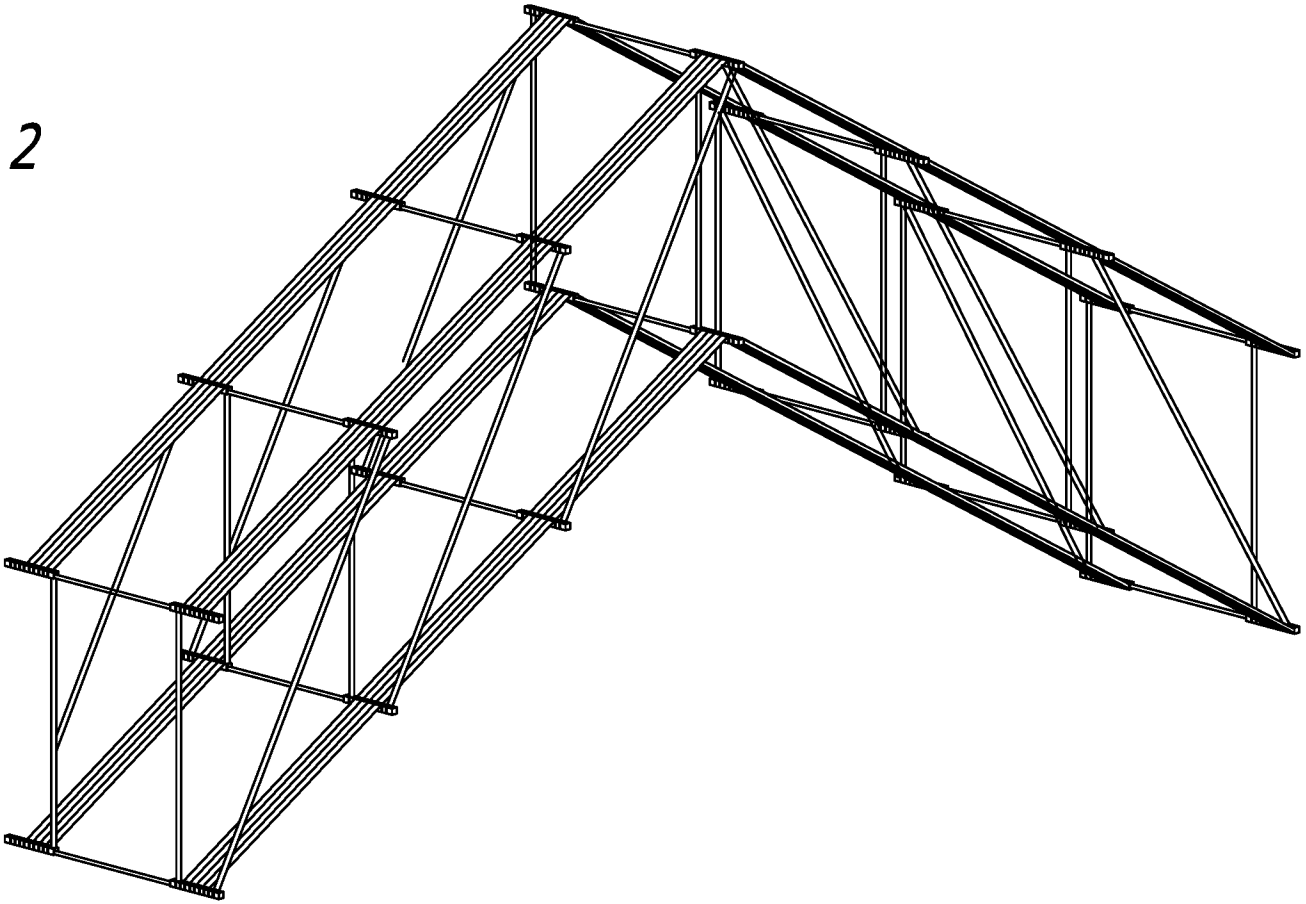
FIG. 2 illustrates an exemplary truss according to embodiments of the invention in a transitional configuration between the deployed configuration and the stowed configuration.
Figure 8:
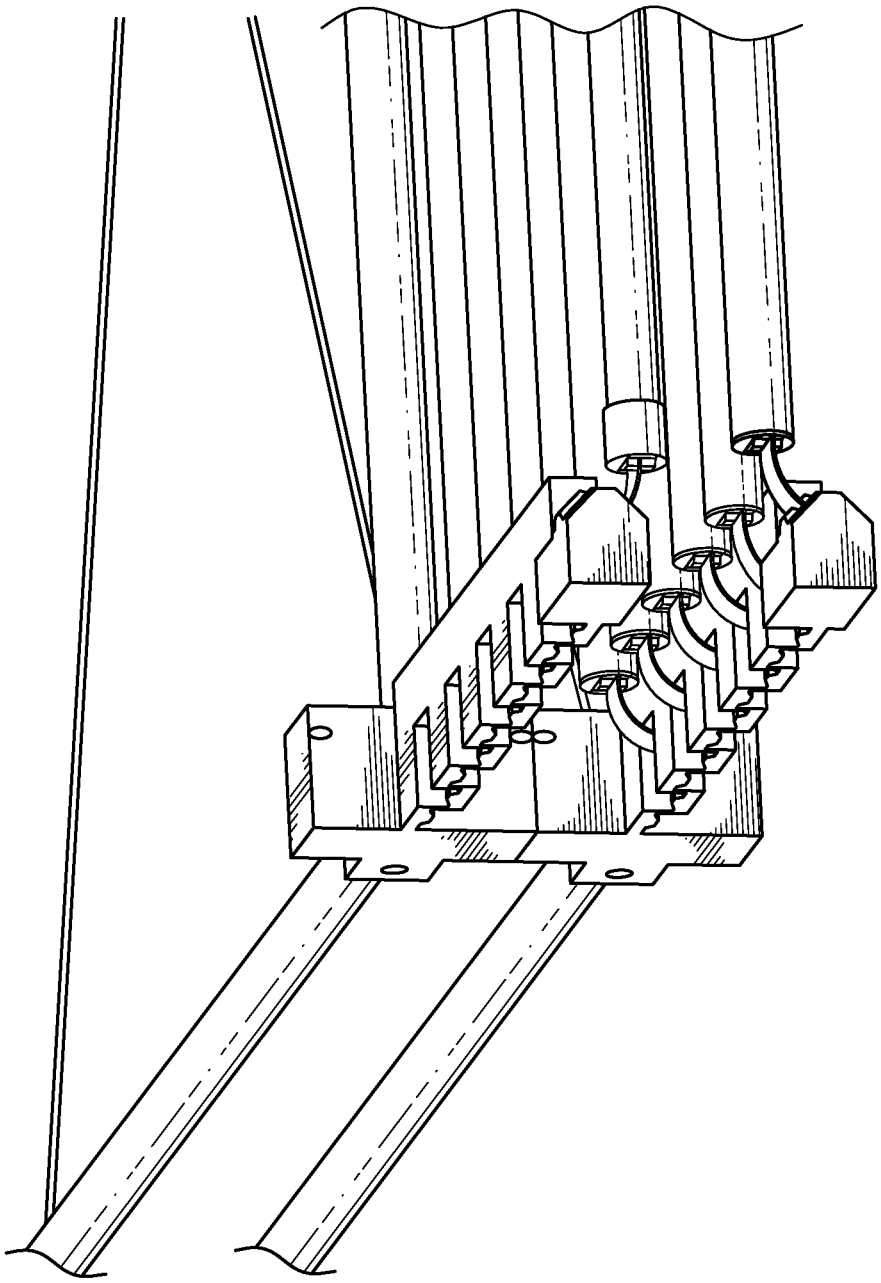

FIG. 8 illustrates a close up of a region of the truss of FIG. 2 including an exemplary end node according to embodiments of the invention in a stowed configuration.

Figure 9:
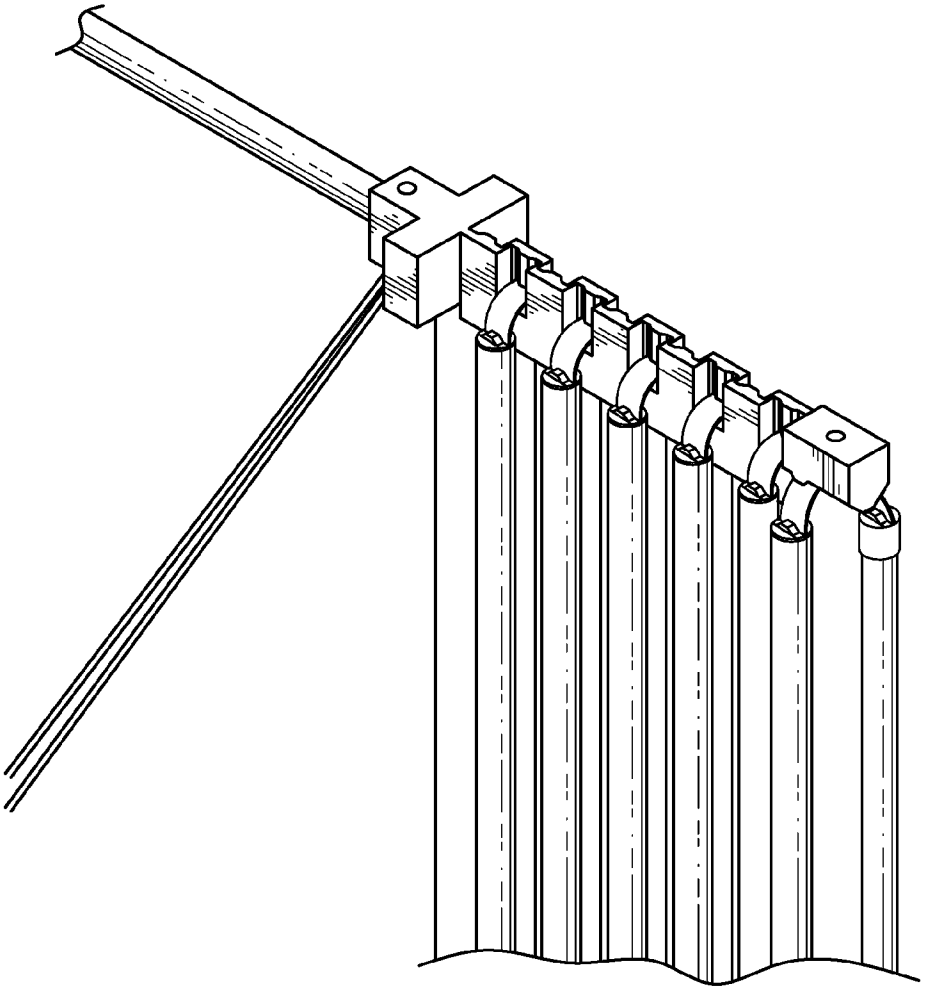

FIG. 9 illustrates a close up of a region of the truss of FIG. 2 including an exemplary interior hinge node according to embodiments of the invention in a stowed configuration.

Figure 3:
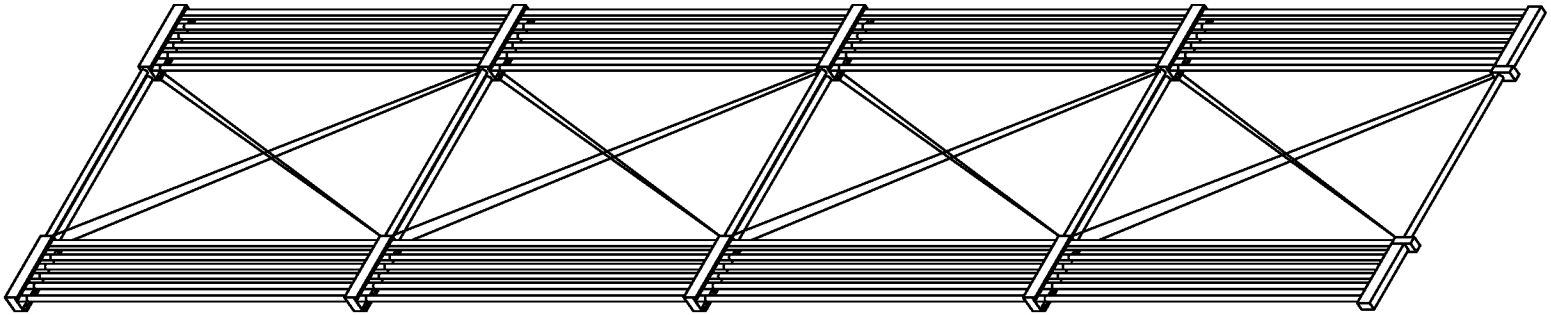
FIG. 3 illustrates an exemplary truss according to embodiments of the invention in a stowed configuration.
Figure 10A:
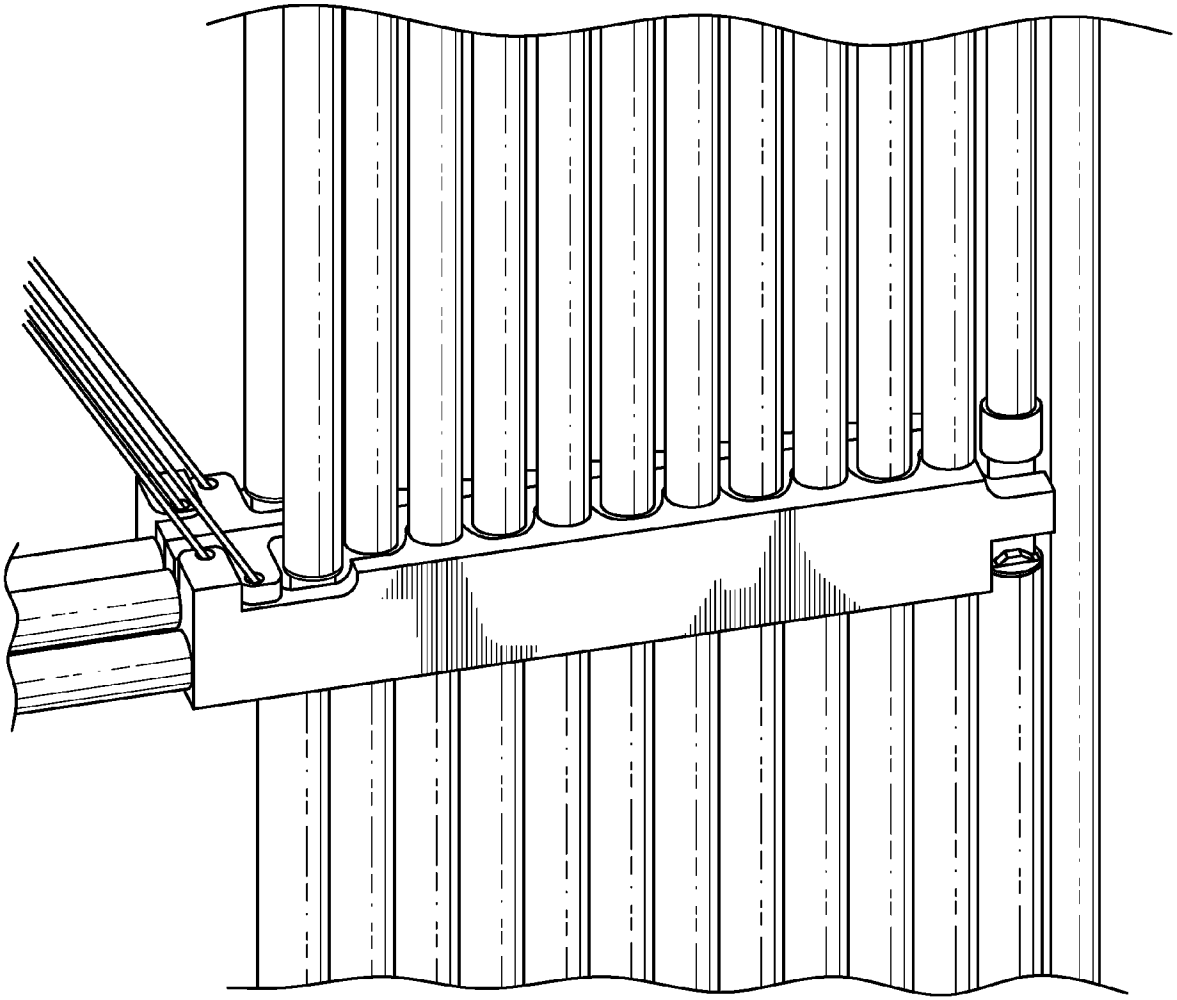
Figure 10B:
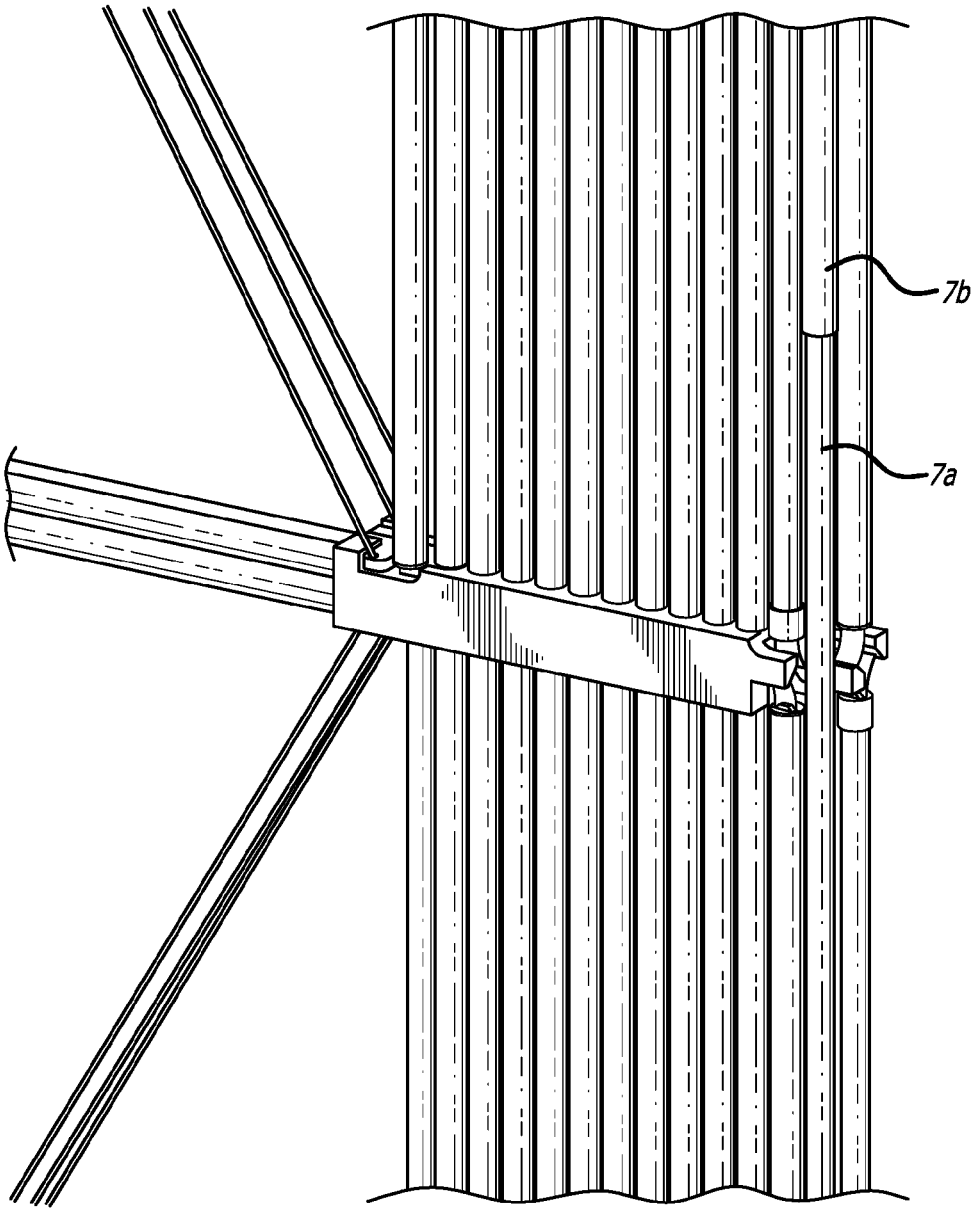

FIGS. 10A and 10B illustrate different perspective close ups of a region of the truss of FIG. 3 including an exemplary interior rigid node according to embodiments of the invention in a stowed configuration.

Figures 11, 11A, 11B, 11C, 11D:
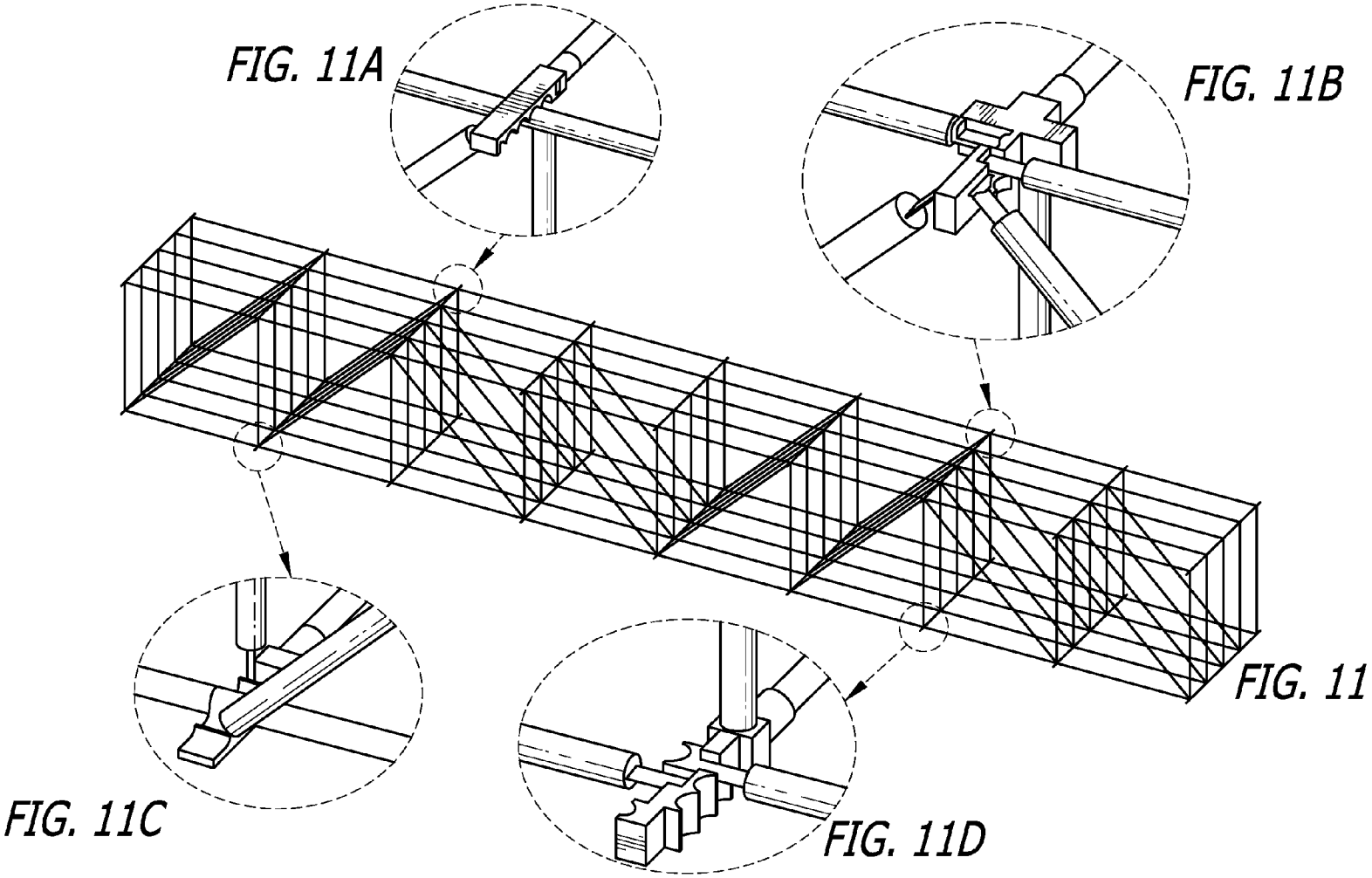

FIG. 11 illustrates another exemplary embodiment of a truss in a deployed configuration. FIGS. 11A-11D illustrate magnified views of joints along the truss of FIG. 11.

Figures 12, 12A, 12B, 12C:
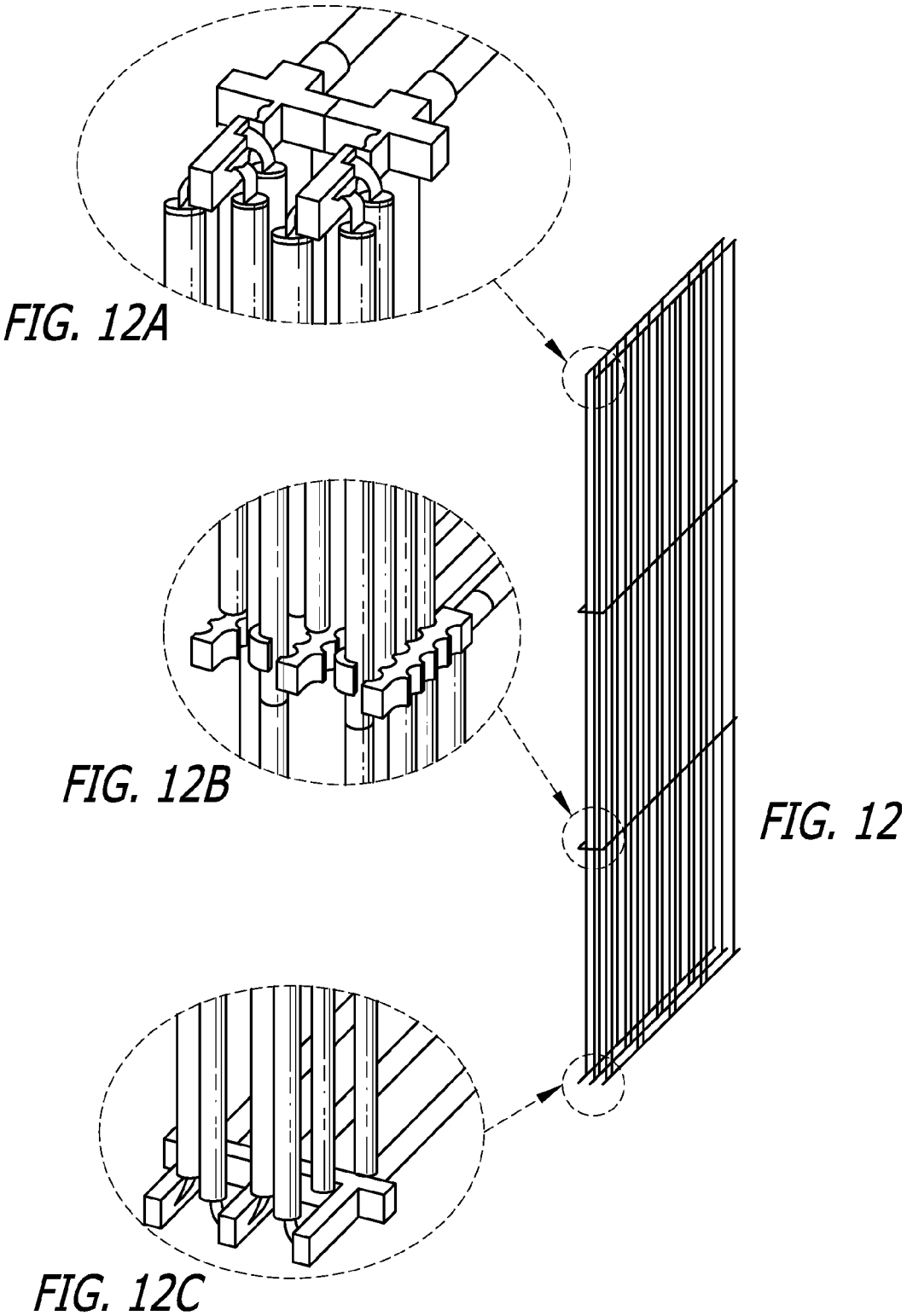

FIG. 12 illustrates another exemplary embodiment of a truss in the stowed configuration. FIGS. 12A-12C illustrate magnified views of joints along the truss of FIG. 12.

Figure 13:
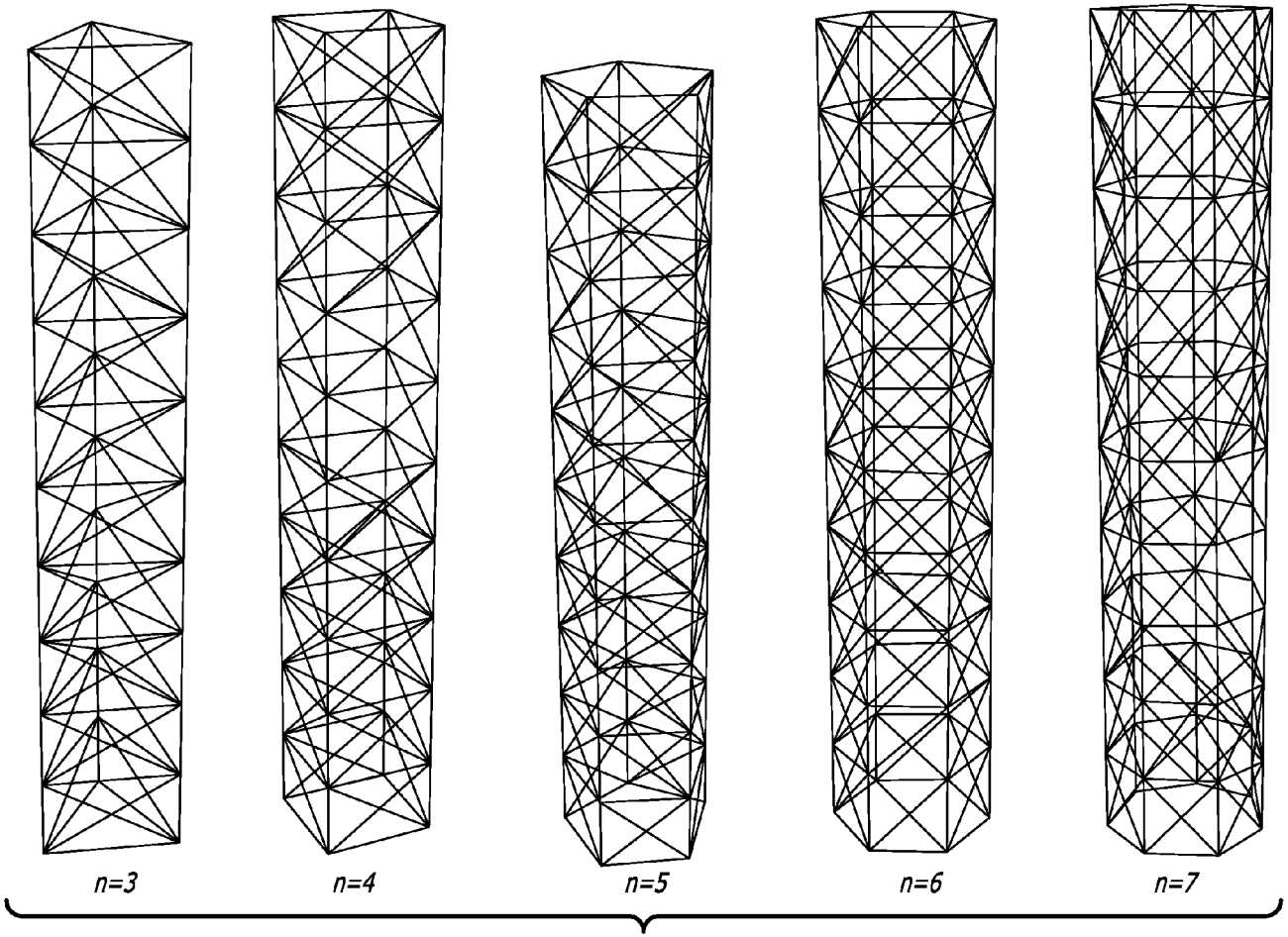

FIG. 13 illustrates other exemplary frame configurations of exemplary trusses that may benefit from features described herein.

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include novel truss designs. Although embodiments of the invention may be described and illustrated herein in terms of linear truss, it should be understood that embodiments of this invention are not so limited, but are additionally applicable to other structural features. Embodiments described herein may be used as building blocks for larger structures. Also, features and configurations may be used alone or in different combinations in other applications and structures.

FIG. 1 illustrates an exemplary truss according to embodiments of the invention in a deployed configuration; while FIG. 2 illustrates the exemplary truss in a transitional configuration. The truss 1 includes battens 3, longeron 5, diagonal 7, nodes 9, transverse diagonals 11, and combinations thereof Generally, the battens 3 and longeron 5 provide the structural rigidity, while nodes 9 provide the connecting elements and flex locations or hinge joints. Diagonal 7 permits the truss to transition between stowed and deployed configurations by providing extendable members.

Battens 3 and longerons 5 are structurally rigid longitudinal members having high axial stiffness and high bending stiffness. In an exemplary embodiment, batten 3 and longeron 5 are rigid tubes; however, other structures may be used, such as rods, cylinders, beams, etc. Diagonals 7 are longitudinal members that comprise a dynamically adjustable length. Diagonals 7 may be constructed similar to the structurally rigid longitudinal members or may be different materials, shapes, etc. Transverse diagonal 11 is a tensile component that may be rigid or flexible. In an exemplary embodiment, the transverse diagonal is a wire-like structure of small cross-sectional dimension compared to its length.

In the deployed configuration, as seen in FIG. 1, the truss 1 comprises a frame comprising a set of battens 3 arranged in a transverse plane of the truss. As shown, four battens 3 are coupled into a generally rectangular or square shape to define a frame. However, other configurations may be used, such as three battens. A series of frames are then used to structurally support the truss in two dimensions. The series of frames may be arranged parallel to each other and separated along a longitudinal length of the truss. Adjacent frames may be coupled longitudinally by a plurality of longerons 5. In an exemplary embodiment, at least one longeron is used to support each apex of the frame, positioned proximate the juncture of two battens. Therefore, if four battens are used to create a rectangular frame, preferably, at least four longerons are used between adjacent frames. Diagonals 7 and transverse diagonals 11 may also be coupled between adjacent frames.

As shown, two sets of longerons may be used to couple adjacent frames on opposing sides of the frame. In an exemplary embodiment, the longerons coupling adjacent frames are contained in parallel planes on opposing sides of the frame. Each plane may contain two or more longerons between adjacent frames. In an exemplary embodiment, each plane contains four to twelve longerons between adjacent frames (or more depending on the size). As shown in FIG. 1, ten longerons are positioned in each plane between adjacent frames, such that twenty longerons are used to couple a first frame to an adjacent second frame. Therefore, each interior frame has forty longerons extending from it. In terms of the frame of reference of FIG. 1, the parallel planes defined by and containing the longerons are parallel to the longitudinal-1st transverse plane. Longerons may be included in additional planes or locations about the truss. In the exemplary embodiment, the longerons are confined to lie within only two planes in the deployed configuration, but do not need to be confined in only two planes. The longerons within a plane may be equally distributed along a width of the truss or may be grouped and contained adjacent the battens 3 or nodes 9. For example, half of the longerons in a plane may be positioned proximate a first end of a batten and half of the longerons in a plane may be positioned proximate a second end of the batten, opposite the first end. As shown, the longerons may be coupled to a connector extending from a terminal end of the batten, such that the longerons are positioned on outside opposing ends of a batten in a direction transverse to the batten. In other embodiments, some or all of the longerons are positioned along a perimeter or a portion thereof of the frame.

Diagonal 7 are coupled between adjacent frames and connected at opposing ends of the diagonal to opposing sides of the truss. In the exemplary embodiment shown, in which the longerons are positioned in planes on opposing sides of the truss, the diagonals 7 are positioned on lateral sides of the truss between the planes of the longerons. Therefore, two longerons are on opposing sides of the truss, and diagonals are on opposing sides of the truss, where the sides containing the longerons are different sides than the sides containing the diagonals.

The diagonals are extendable longitudinal members that permit the truss to collapse in the stowed configuration. Exemplary diagonals collapse from a first longer length in the stowed configuration to a second shorter length in the deployed configuration. As shown, telescoping tubes are used to create the dynamic length of the diagonal. An inner tube 7*a* is positioned within a lumen of an exterior tube 7*b*, as seen in FIG. 10B. To lengthen the diagonal, additional portions of the interior tube are exposed, thus permitting the structure to translate from a generally rectangular-box configuration to a parallelogram-box configuration, and ultimately to the collapsed or stowed configuration. Other extendable members may be use such as collapsible, flexible, or stretchable members.

The diagonals 7 may be structurally rigid or lockable in the deployed configuration. For example, the diagonals may be adjusted from the longer position to the shorter position, such as with telescoping, rigid tubes. Exemplary embodiments may also include a locking mechanism to retain the diagonals in a deployed and/or stowed configuration. The locking mechanism may be one way and/or automatically actuated, such that the locking mechanism retains the diagonal in the reduced length configuration once fully deployed.

The transverse diagonal 11 are optional. These tensile members may be included to retain the shape of the truss between frames. Transverse diagonals may be included, for example, when the majority of the truss length is otherwise free or unsupported between adjacent frames. In the exemplary embodiment in which the longerons are not equally positioned along a width of the truss, the longerons are localized adjacent corners of the truss and leave the interior width of the truss frame unsupported. As shown, when the longerons are positioned adjacent the batten terminal ends, the interior length of the batten is free from supports between adjacent frames. The transverse diagonal 11 therefore may be positioned between opposing sides of the truss between adjacent frames. The transverse diagonal 11 may be positioned in any of the planes of the truss. As shown, four transverse diagonals are used between adjacent frames, with two transverse diagonals positioned on the same side of the truss between adjacent frames. The shown transverse diagonals crisscross to form an x-shape across a face of a truss section between adjacent frames. The transverse diagonal may be solid or hollow wires of any cross sectional shape, such as circular, or may be a planar ribbon configuration. The transverse diagonal 11 may be rigid or flexible.

The structure is held together at nodes 9, which couple the longerons 5, battens 3, diagonals 7, and transverse diagonals 11 together. The nodes 9 permit the support members to be rigid and support the structural forces of the object, while permitting the collapse and flexibility to be contained in localized components. Therefore the structure comprises various nodes. As shown, a flexible node 9*b* permits the longerons to flex on both sides of the connector such that the structure can bend at that node. A rigid node 9*c* may be used where the longerons are rigidly attached and do not rotate or move relative to the node. An end node 9*a* may be either a rigid node or a flexible node. As shown, the end node 9*a* is a flexible node on one side. Therefore, the truss structure may be serially attached to other similar truss structures to create building block type larger frames and permit their continued collapse, one on top of another.

As shown, two rigid nodes are positioned between adjacent flexible nodes. However, any combination of rigid to flexible nodes may exist. For example, every other node may be rigid and flexible, or every two nodes may be rigid to a flexible node. The selection of rigid nodes and length of longerons informs the length of the stowed configuration. As shown, the truss is mirrored around the flexible nodes. Therefore, the diagonals are positioned such that the frame corresponding to the flexible nodes have diagonals emanating out of the same side of the truss extending in both longitudinal directions of the truss, while the opposite side of the frame including the hinge nodes does not have any diagonals extending from it. Therefore, the diagonals for a V or inverted V shape at the hinge node. Each pair of diagonals on lateral sides of a truss cell create parallel planes in both direction from the flexible node, where the planes on each side are parallel to an adjacent plane, but angled with respect to planes on the opposite side of the flexible node.

In an exemplary embodiment, each node provides a rigid connection to the batten to which it extends. Therefore, two nodes 9 are permanently and immovably coupled to each, opposing terminal end of a batten 3 and extends in the longitudinal length past the end of the batten. Each node is also either flexibly coupled to another batten, transverse to the batten from which the connector extends or to the longerons, also extending transverse to batten from which the connector extends. Each node is also either rigidly coupled to another longeron, extending transverse to the batten from which the connector extends or to a batten, extending transverse to the batten from which the connector extends. As shown, one attachment is rigid while the other attachment is flexible. Therefore, if the other batten attachment is rigid, then the longeron attachments are flexible, or if the longeron attachments are rigid, then the batten attachment is flexible. Therefore, any connector has a rigid attachment to a batten and a rigid connection to either the longeron or another batten and a flexible connection to either the batten or longeron. This configuration permits the structure to collapse into the stowed configuration.

FIG. 2 illustrates the exemplary truss in a transition position from the deployed configuration toward the stowed configuration. The flexible nodes have hinge or flexible attachments to the longerons, permitting them to rotate relative to the node. The battens defining a frame however are rigid and do not move relative to each other. At the next adjacent frame position, the node is illustrated as rigid, such that the longerons attached to this node do not rotate or otherwise move relative to the node. The entire length therefore stays straight. To accommodate the collapse of the structure, the diagonals extend in length, and the batten of the frame is hinged or comprises a flexible attachment so the batten can move relative to the longerons and the node to which it is attached. Therefore, the structure forms a parallelogram-type structure as seen from the side. FIG. 3 illustrates the truss in the fully collapsed position in which the two sides are brought together and the device lays flat.

As shown, each node is a longitudinally extending member in which a first batten is rigidly attached at its longitudinal terminal end. Another batten and one or more longerons are attached and extend in different directions transverse to the connector.

The connector may include a rigid connection to the longitudinal members. For example, the connector may include a projection or post extending therefrom to create a support for the rigid attachment. The attached tube or component may be fit over the projection or post and be bonded thereto to create the rigid attachment. Any rigid attachment may be made in which the connected member does not move relative to the node.

As seen in FIG. 6A, a rigid node rigidly attaches longerons on opposing sides of the connector. As shown, the longerons on opposing sides are aligned. The rigid attachment may include posts on the connector extending into an interior of the longeron tubes and bonded thereto. In an exemplary embodiment of a rigid node, the housing includes a shaped body. On a first side of the body, the housing is planar. The planar surfaces can abut other planar surfaces of other connectors in the stowed configuration. The opposite side of the connector is shaped or contoured around the components extending therefore. As shown, the opposite surface defines an almost semi-circular like sinusoidal shape. The apex of each curve corresponds to the attached longeron to which the connector retains. The trough of each curve corresponds to a space between longerons and fits the apex of another connector when in the stowed configuration. For example, as seen in FIG. 10A, when collapsed, a longeron of a different cell of the truss may be positioned within the gaps defined by the longerons connected to a node, such that two nodes are configured with mated surfaces to couple and align when collapsed.

The connector may include flexible attachments, such as a hinge or joint between the connector and attached tube or component. The exemplary flexible attachment may be any hinge or joint that permits the attached member to rotate (or translate) relative to the connector. The exemplary connector is best seen in FIG. 6*c*. The hinge comprises a flexible member material extending between the connector and rigid longitudinal component. The flexible member may be a planar, longitudinal member, or a curved, longitudinal surface. As shown, the curved is in a cross sectional plane and is of constant radius thereby forming an arc of a circle if taken in cross section and comprises a constant thickness. The flexible member is configured to flex in one direction toward the concave side and resist motion in the opposite direction. Therefore, the flexible attachment may be biased in a single direction or define an outer limit to permit motion. As shown, the outer limit of the flexible member is created by the member itself and resists extension of the member past the straight extension of the member.

The illustrated flexible attachment provides a hinge joint with stored energy to assist in deployment. The illustrated joint also provides a rotational limit for the joint to move. Other joints may be used with or without these features. Other components may be used to provide a deployment mechanism or may provide a stop to the deployment range. In this case, or if these features are not desired, other hinges may be used. For example, a pin joint or ball joint may be used as the flexible connection.

Figure 4A:
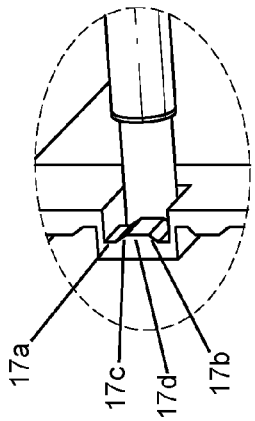
FIGS. 4A and 4B illustrate magnified views of joints of the truss of FIG. 4.
Figure 5:
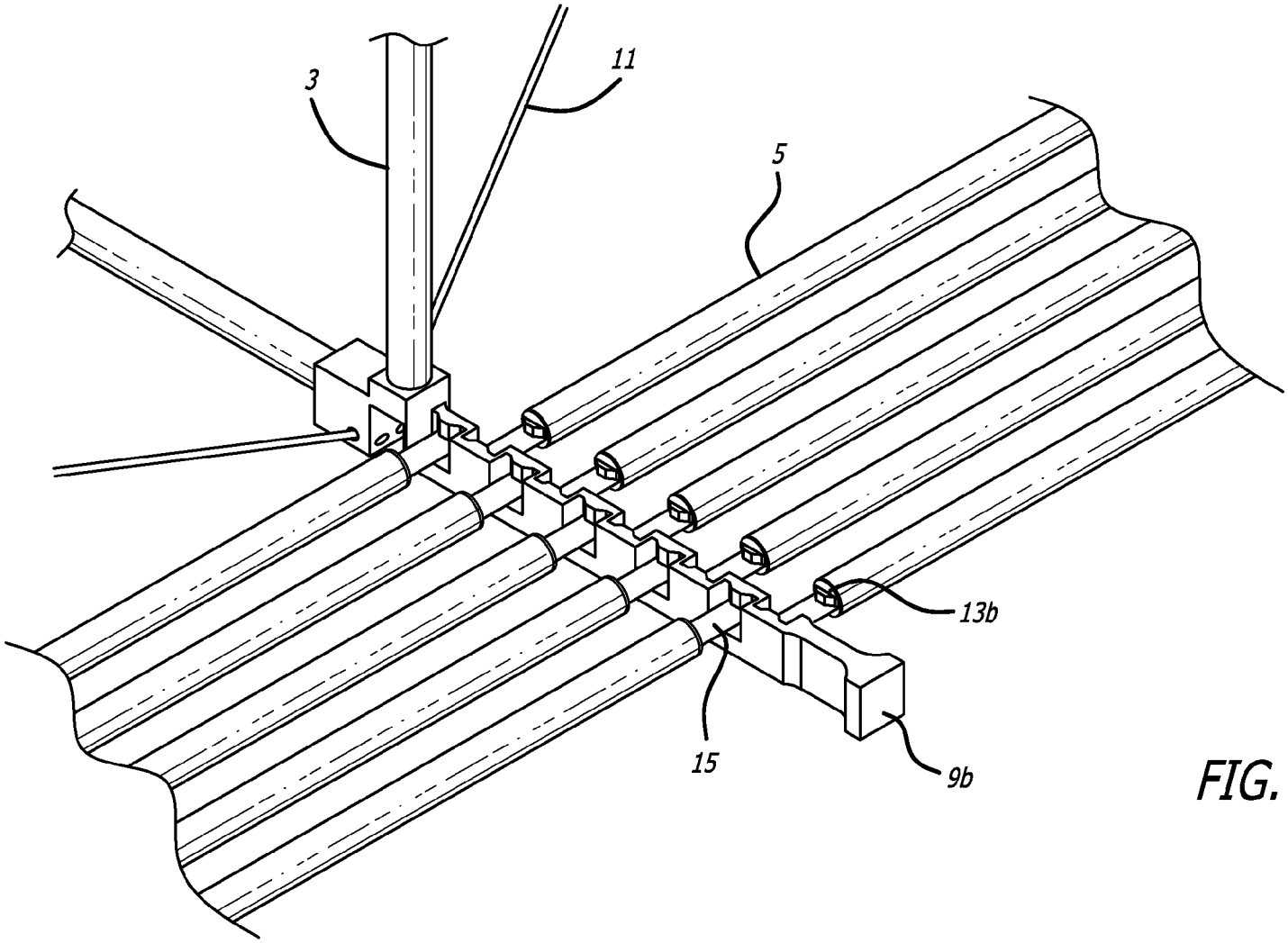
FIG. 5 illustrates a close up of a region of the truss of FIG. 1 including an exemplary interior hinge node according to embodiments of the invention in a deployed configuration.

As seen in FIG. 5, a flexible node flexibly attaches longerons on opposing sides of the connector. The flexible attachment permits the longerons to rotate about the connector. As shown, the longerons extending from opposing sides of the connector are offset. The offset permits the longerons to fit together in which a longeron of a first connector is positioned between two longerons of another connector in the stowed configuration. The housing of the flexible node may also include indentations that extend the width of the hinge. The indentation may define an open end and a closed end. The indentation includes a shaped surface as seen in FIG. 4A. The shaped surface may be a generally curved surface. In an exemplary embodiment, the shaped surface includes generally linear section 17*a* extending inward from an exterior side of the indentation aligned with an edge of the hinge. The shaped surface then includes an inward concave curved surface 17*b* followed by an inward convex surface 17*c*, where inward is intended to be the perspective, within the indentation area to orient the concavity. The shaped surface is mirrored about its center, such that the shaped surface includes two inward concave and two inward convex curved portions. The inward convex portions 17*c* may be separated at the center of the indentation by a generally linear portion 17*d*. The indentations also include an aperture at the closed end or an interior end of the indentation. The aperture is separated from the closed end of the indentation as seen in FIG. 15 such that a portion of the contoured surface is on an interior side of the flexible member concave side. The aperture extends perpendicular to the indentation or the linear portions of the shaped surface. The aperture may extend through the connector such that the hinge may be seen or exposed through both sides of the aperture. The aperture may also be closed at one end. The aperture is curved to correspond to the curvature of the flexible member or hinge. The aperture is positioned relative to the indentation such that the aperture is concave toward the closed end of the aperture. Therefore, the flexible member is configured to about the connector toward the closed end of the aperture. The housing of the connector is configured such that it creates a stop for the hinge when the hinge is bent to the collapsed configuration, such that a portion of the component to which the hinge attaches abuts a portion of the connector to prevent further motion of the component with respect to the connector.

Figure 4B:
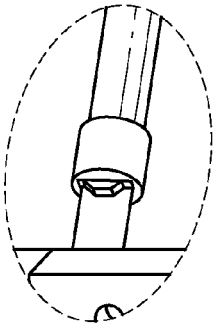

The flexible attachment may couple to the longitudinal member in any fashion. In the exemplary embodiment shown, the longitudinal members comprise tubes including a cap positioned at a terminal end. The cap 13*a* includes is positioned either internally and/or externally to the tube to create an end surface to the tube. The end surface includes an aperture shaped to correspond to the flexible member. Similar to the attachment to the connector, the aperture is generally curved to accommodate the curvature of the flexible member. Similar to the aperture of the housing, the aperture may extend through the cap and have two open ends or may extend only partially through the cap and have a closed end. Similar to the indentation of the connector adjacent the attachment to the flexible member, the cap includes a shaped surface. As seen in FIG. 4B, the shaped surface similarly includes linear exterior ends that transition to outward concave then to outward convex curved portion to be coupled at the center by a linear portion. The shaped surface defines a longitudinal terminal end portion of the cap. The shaped surface may be on a projection of the cap adjacent the aperture of the flexible member or may extend across the terminal end of the cap.

In an exemplary embodiment, the cap includes a closed end to the aperture such that the flexible member may be fully seated within the aperture. The longitudinal members may then be coupled with respect to the connector by positioning the flexible members into respective apertures of the connector and using a spacer, accurately position the members during manufacture. By having the open end on the connector, manufacturing tolerances of the connector do not need to be precise as any excess material may be removed from the aperture after attachment.

The connectors may also permit attachment to the transverse diagonals. As shown, the connectors include an aperture 21 in which the transverse diagonal members are threaded and bonded therein. The transverse diagonal members may be otherwise coupled to the connector, such as tied, riveted, friction fit, bonded, etc.

Figure 4:
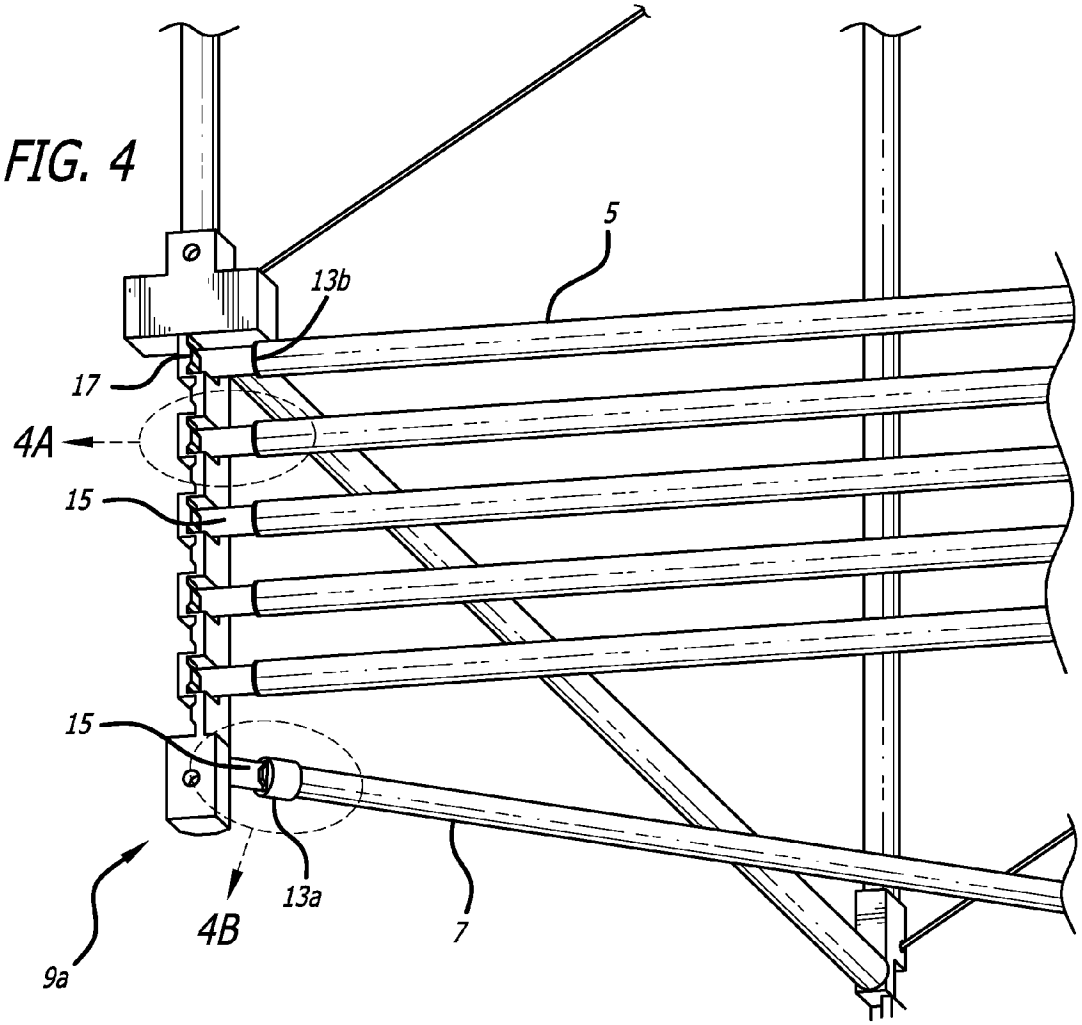
FIG. 4 illustrates a close up of a region of the truss of FIG. 1 including an exemplary end node according to embodiments of the invention in a deployed configuration.

FIG. 4 illustrates a close up of a region of the truss of FIG. 1 including an exemplary end node according to embodiments of the invention in a deployed configuration. FIG. 4A and FIG. 4B are close up sections of FIG. 4 of the attachment of the flexible member 15 to the connector 9*a* and cap 13*a*. As shown, the end node 9*a* includes flexible connectors to the longerons 5 and diagonal 7 and rigid connections to two battens 3. A flexible member 15 is used to couple the components. Different configurations of the connector cap are shown in which one cap 13*b* fits within the longitudinal member and one cap 13*a* fits around the longitudinal member. As shown, the end node includes a shaped surface 17 adjacent the flexible member at the attach to either the connector or the cap of the longitudinal member. Because it is an end node, the longerons extend in only one direction. As seen, the longerons are spaced from each other to define a gap between longerons of a distance approximately equal or greater than the diameter of a longeron.

FIG. 5 illustrates a close up of a region of the truss of FIG. 1 including an exemplary interior hinge node according to embodiments of the invention in a deployed configuration. The illustrated node of FIG. 5 is a hinge node in which the longerons are configured to rotate relative to the node. As seen, the hinge node 9*b* includes longerons 5 extending on opposing sides. Similar to the end node, longerons extending from the same side of the flexible connector are separated by a gap approximately equal to or greater than a diameter of a longeron. The longerons are offset from one side of the connector to the other. The longerons 5 are coupled to the node 9*b* by flexible members 15. The node rigidly coupled two battens 3 to the connector. Transverse diagonal members 11 are also coupled thereto. Two different pairs of flexible nodes are used to create a single frame coupling four battens. The first pair, as shown in FIG. 5, do not have any diagonals attached thereto. The second pair, have two diagonals extending on opposing sides of each node.

FIG. 6A illustrates a close up of a region of the truss of FIG. 1 including an exemplary interior rigid node according to embodiments of the invention in a deployed configuration. FIG. 6B illustrates the exemplary rigid node of FIG. 6A, with a set of longerons transparent to illustrate the internal connection between longeron and node. FIG. 6C illustrates a different perspective close up of the region of FIG. 6A. The rigid node 9*c* includes rigid attachments of the longerons 5 to the node. The rigid attachment may be through a post 19 on the node or another attachment. The rigid nodes include flexible attachments to one batten 3 and the diagonal 7 with the use of a flexible member 15 and cap 13*a*. The transverse diagonal 11 may also be attached to the node.

FIG. 7 illustrates a cut away cross section across a node in the stowed configuration. The exemplary embodiment illustrates the attachment of the flexible member to the cap and node. As seen, the flexible member extends through the aperture in the node, but only partially through the cap, such that the cap has an open end and closed and, while the node has two open ends. FIG. 7 illustrates the cut away in a stowed configuration, such that two nodes are positioned adjacent one another. The adjacent nodes include mated surfaces such that the nodes collapse together without separation between the nodes. FIG. 7 also illustrates the exemplary rigid connection of a longitudinal member, such as batten 3 with the node using a post 19. The cut away also illustrates the aperture 21 used to thread the transverse diagonal to attach it to the node as well. Each of the components, the flexible member, cap, longitudinal members, and transverse diagonal member may be bonded to the respective components once positioned.

FIG. 8 illustrates a close up of a region of the truss of FIG. 2 including an exemplary end node according to embodiments of the invention in a stowed configuration. As shown, the flexible members permit the longerons to rotate about 90 degrees relative to the node between the stowed and deployed configuration. The diagonals are configured to rotate about 45 degrees between the stowed and deployed configurations. FIG. 8 illustrates the collapsed configuration of the end nodes such that the longerons do not interlineate with longerons of another node. As seen, the flexible member permits the longerons to reposition relative to the node. However, the node body engages or contacts the longeron to act as a stop to further rotation of the flexible member relative to the node in the collapsed configuration.

FIG. 9 illustrates a close up of a region of the truss of FIG. 2 including an exemplary interior hinge node according to embodiments of the invention in a stowed configuration. As shown, the longerons are offset when collapsed such that longerons of different nodes may be positioned between longerons of the illustrated node. Because of the alignment of the longerons across the rigid node, and the offset of the longerons on the flexible nodes, the longerons are may not be linearly aligned or continuous along the entire length of the truss in the deployed configuration.

FIGS. 10A and 10B illustrate different perspective close ups of a region of the truss of FIG. 3 including an exemplary interior rigid node according to embodiments of the invention in a stowed configuration. As seen, four nodes are brought together in which two pairs include mated surface such that the longerons of the pair interlineate. The interlineated pairs are then positioned in a stack-like arrangement one on top of the other. This configuration permits an exceptionally small stowage configuration. The nodes therefore create mated pairs, around the longerons, as well as around the diagonals and the attachments to the transverse diagonals. Therefore, each component is offset to mate with the component on a paired node. As seen in FIG. 10B, the nodes may include different lengths to accommodate the position of an extended diagonal across the nodes.

FIG. 11 illustrates another exemplary embodiment of a truss in a deployed configuration. In this configuration, longerons are positioned equidistantly across surfaces of the truss. Additional batens and diagonals are positioned along the interior of the truss as well. The configuration of FIG. 11 also uses different nodes since it is attaching different combinations of longitudinal members. The system still takes advantage of flexible members between the longitudinal member and the node to create the flexible hinge. The embodiment of FIG. 11 also illustrates additional flexible and rigid node combinations along the length of the truss. As shown, the nodes alternate between flexible and rigid such that a cell of the truss has a rigid node on one side and a flexible node on another side. Each of the flexible nodes are apparent as the diagonals are in mirrored directions from the flexible node. Also as shown, when multiple flexible nodes are used in the same truss, the arrangement of the flexible nodes positions are zig-zagged across truss sides such that the apex of the diagonals on sequentially opposite sides of the truss alternate. FIG. 12 illustrates another exemplary embodiment of a truss in the stowed configuration. As shown, the nodes may still form mated pairs that interlineate to form a compact structure.

FIG. 13 illustrates other exemplary frame configurations of exemplary trusses that may benefit from features described herein. Various features are provided herein including novel materials, truss designs, flexible members, etc. No one feature is considered essential to the invention, but each may be used by itself or in combination with any other feature to achieve a desired benefit. For example, the flexible member may be used in other applications to provide the rigid support but flexible attachment as described herein. Accordingly, the scope of the invention is not limited to the specific configurations disclosed, but includes any combination of features described herein. Features and components may also be subdivided, integrated, removed, duplicated, or otherwise recombined and stay within the scope of the instant invention.

In an exemplary embodiment, the structurally rigid longitudinal members, such as batten 3, longeron 5, diagonal 7, and other components described herein may be composed of strong, rigid, light-weight materials. For example, a carbon fiber composite may be used to define a carbon fiber and epoxy matrix. The fibers may be aligned, woven, unidirectional-concentric or -layered plies (such as cylindrical layer or planar layer) of cross directional plies. In an exemplary embodiment, adjacent plies may be angled with respect to another or an adjacent ply by 25 to 90 degrees, or 45 degrees. Other materials and structures can be used. For example, solid structures may be used, or hollow structures of different cross section are also within the scope of the instant disclosure. Other materials may also be used, such as metals, plastics, composites, etc. The composite longerons, battens, telescoping diagonals may be made of IM9 carbon fibers and epoxy matrix. Exemplary components may be tubular members with a radius to wall thickness ratio of ~19. Each tube length may be, for example, 0.5 to 1.5 meters long with a slenderness of 100 and thickness of 0.1-0.4 mm. The composite may be woven such that 80% of the fibers are in the axial direction. The weave material may provide some torsion stiffness, prevent local wall buckling and provide robust handling. All these components may be bonded with Hysol EA 9309.3NA adhesive, for example.

In an exemplary embodiment, the flexible members comprise a material of high axial stiffness and bending stiffness, but because of their configuration, are still able to bend and permit the designed flexibility. In the exemplary shown embodiment, these thin composite tape spring laminates may comprise IM9 carbon fibers and toughed epoxy matrix. They may be resistant to creep. Also, they may have a very small coefficient of thermal expansion.

In an exemplary embodiment, the flexible member sandwiches unidirectional plies with plain weave plies at 45 degrees to add shear stiffness and local bending stiffness to the laminate. The shear stiffness of the woven plies adds to the strain achieved by the unidirectional plies. Compressed unidirectional materials typical fail in a shear mode when compressed. The shear stiffness provided by the plain weave suppresses this failure mode. The laminate thickness may be approximately 0.1-0.5 millimeters. Each flexible member may be 6-10 mm in length. The exemplary hinge has a good balance of mechanical properties such as ~2% bending strain and ~98 GPa modulus.

In an exemplary embodiment, the tensile components, such as transverse diagonals may be flexible or rigid components. In an exemplary embodiment, the tensile components are string-like in that they are hollow or solid long pieces of reduced cross section. In an exemplary embodiment, the tensile component is a wire comprising metal, plastic, fiber, composite, and combinations thereof. In an exemplary embodiment, the wire comprises a carbon fiber composite that is flexible. The wire may alternatively be, for example, 0.035 inch, 7×7, 304 stainless steel wire rope.

The truss of the instant application may be used in many different applications. Surface structures may be positioned on the truss or be supported by the truss. For example, solar array panels may be positioned between frames on the cell faces of the truss. Because the frames and certain faces of the cells defined between frames do not move relative to one another, the material or supported structure does not have to bear deployment forces and strains.

The terms longeron, node, joint, hinge, diagonal, and batten are used herein to describe different components of the exemplary truss. These terms are not limited to their traditional meanings and are not defined thereby. For example, a batten is generally a long, flat strip, whereas, exemplary embodiments described herein include tubular structures. Accordingly, the term should be understood to be consistent with the disclosure of the instant application. In general, the terms are used to describe the various structure components and are not intended to be constrained to any preconceived dimension, shape, configuration, function, or application. As used herein "wire" is intended to include an configuration of a flexible, slender component that is not attributed to a certain material or cross-sectional shape.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims.

The invention claimed is:

1. A collapsible truss, comprising:

a plurality of frames are longitudinally positioned along a longitudinal length of the collapsible truss, wherein each of the plurality of frames is defined by a plurality of battens;

a plurality of rigid longerons coupling adjacent ones of the frames, wherein the adjacent frames and the connecting longerons between the adjacent frames define a cell;

a plurality of flexible nodes flexibly coupling the longerons on opposing sides of the flexible node;

a plurality of linearly extendable diagonals coupling the adjacent frames; and a plurality of rigid nodes rigidly coupling the longerons on opposing sides of the rigid nodes.

2. The collapsible truss of claim 1, wherein each of the plurality of flexible nodes is created by a flexible member between one of the plurality of rigid longerons and one of a plurality of nodes.

3. The collapsible truss of claim 2, wherein the flexible member is a longitudinal member of curved, constant-thickness cross section.

4. The collapsible truss of claim 2, wherein the plurality of rigid nodes includes a rigid attachment to at least one of the battens and a flexible attachment to at least one of the battens.

5. The collapsible truss of claim 2, wherein the extensible diagonals are flexibly coupled to the adjacent frames.

6. The collapsible truss of claim 5, wherein the longerons extending on opposing sides of the rigid node are coaxially aligned.

7. The collapsible truss of claim 5, wherein the longerons extending on opposing sides of the flexible node are coaxially misaligned.

8. The collapsible truss of claim 2, wherein the plurality of flexible nodes includes a rigid attachment to at least two of the battens.

9. The collapsible truss of claim 8, further comprising transverse diagonals coupled between the adjacent frames.

10. The collapsible truss of claim 9, wherein each of the plurality of frames are rigid structures and do not deform, and each of the rigid longerons are rigid components and do not deform.

11. The collapsible truss of claim 10, wherein the plurality of linearly extendable diagonals comprise telescoping tubes.

12. The collapsible truss of claim 11, wherein the longerons, battens, and telescoping tubes comprise composite tubes.

13. The collapsible truss of claim 12, wherein the composite material comprises a carbon fiber-epoxy matrix.

14. The collapsible truss of claim 13, wherein at least ten of the longerons are positioned between the adjacent frames.

15. The collapsible truss of claim 14, wherein the longerons are not equally positioned along a width of the truss, but are localized adjacent corners of the truss.

16. The collapsible truss of claim 15, wherein the plurality of flexible nodes comprise indentations in which the flexible member is attached, wherein the indentation includes a shaped surface comprising two inwardly convex portions.

17. The collapsible truss of claim 16, wherein the indentations comprise a closed end, wherein a concave curved surface of the flexible member faces the indentation closed end.

* * * * *